US005813325A

United States Patent [19]

Descovich

[11] Patent Number: 5,813,325

[45] Date of Patent: Sep. 29, 1998

[54] RING MARKER

[75] Inventor: Kurt Descovich, Vienna, Austria

[73] Assignee: Medek & Schürner Gesellschaft m.b.H., Vienna, Austria

[21] Appl. No.: 700,193

[22] Filed: Aug. 20, 1996

[51] Int. Cl.[6] ..... B41F 17/10

[52] U.S. Cl. ..... 101/36; 101/35

[58] Field of Search ..... 347/4, 38; 101/35, 101/36

[56] References Cited

U.S. PATENT DOCUMENTS

| | | | |
|---|---|---|---|
| 2,993,434 | 7/1961 | Johnson et al. | 101/35 |
| 3,225,688 | 12/1965 | Gillies et al. | 101/36 |
| 3,229,625 | 1/1966 | Pannier | 101/35 |
| 4,056,343 | 11/1977 | Kaiser et al. | 101/36 |
| 4,299,163 | 11/1981 | Raahauge | 101/36 |

*Primary Examiner*—Edgar S. Burr
*Assistant Examiner*—Amanda B. Sandusky
*Attorney, Agent, or Firm*—Friedrich Kueffner

[57] ABSTRACT

A marking device for applying markings to the insulating sheathing of a wire comprising two color disks alternatingly moved between active and inactive positions by a common carrier to selectively apply markings to the wire.

3 Claims, 2 Drawing Sheets

RING MARKER

The invention relates to a ring marker. Such devices are used in the cable industry for applying color markings, so-called signatures, or codings, to the insulating layers of the individual wires prior to winding a cable, in order to make it possible for the assemblers and users to correctly assign and connect the cables consisting of many thin individual wires.

The individual wires usually consist of copper and are surrounded by an electrically insulating sheathing. The color markings are applied with regular spacings, for example, a spacing of approximately 15 mm, and have the form of a color ring extending around the individual wire. Since the marking devices must keep pace with the manufacture of the wire, speeds of about 20 m/s and up to just below 40 m/s are usual. This means that the ring-shaped color markings must be applied with an extremely high cycle frequency.

Machines used for this purpose are essentially constructed as follows: the core of the device is a color disk (frequently also called nozzle wheel) of metal with a circumferential groove which has a great radial depth and through which the wire is pulled directly after the insulating sheathing has been extruded onto the wire, generally while the insulating sheathing has not yet hardened. The interior of the color disk is hollow and the color disk has essentially radially extending channels which in the shoulder area of the circumferential groove open out obliquely in circumferential direction as well as in radial direction. A larger hollow space which is in connection with the individual channels and openings is provided in the center of the color disk. A coloring agent is introduced into this hollow space by suitable measures.

The color disk rotates at a predetermined rate of rotation in dependence on the speed of the wire. As a result of the rotation of the color disk, the coloring agent introduced into the hollow center of the color disk is guided and accelerated in such a way that the coloring agent is propelled through the channels to the outside and out of the openings. The angular position of the ducts is selected in such a way that the wire is marked as a color disk nozzle rotates past the wire. In order to achieve a particularly satisfactory result, a synchronization is provided of such a type in which a semicircular ring is sprayed on to the wire on the radially inner side when the wire enters the groove and the remaining radially outer half of the ring is sprayed on when the wire exits the groove.

Devices of this type have long been known and operate essentially without problems. In order to minimize inventories and in order to achieve a continuous production sequence, it is necessary to apply different codings as much as possible without standstill onto a continuously traveling wire in one and the same wire manufacturing train. For this reason, twin marking devices are increasingly used in which two of such color disks are arranged one behind the other in the direction of wire movement (frequently also called wire travel direction), wherein, however, only one of these devices is active, while the wire travels through the other device without being marked or otherwise changed by this device.

Since the wire travels essentially without contact through the circumferential groove of the color disk, this travel through the twin marking devices does not pose a problem. When changing over from one type of marking to another, the one device is merely stopped and the other is started up synchronously therewith which, together with the useless front portions and end portions of the wire which inevitably occur when reeling the wire, this has the result that the marking can be changed practically without losses and especially without stopping the process of insulating the wire.

The twin marking devices mentioned above are to be distinguished from those which apply multiple-color markings on a wire. These multiple color marking devices, in which at least two color disks are in operation simultaneously, are not the subject of the present invention.

Insulating materials of a very special type have now been used increasingly for some time. These insulating materials are composed essentially of foaming materials which foam during the extruding process, particularly immediately following the extruding process, and which produce an insulating sheathing around the wire which is porous and contains an extremely high amount of air. By applying an additional skin of synthetic material, a smooth and essentially pore-free surface is produced on the outer surface of the insulating layer.

In this type of insulation materials, for achieving a desired and predetermined (standardized) capacity of the wire per unit of length, it is essential that the thickness of the insulation is maintained as exactly as possible in dependence on its porosity and other parameters. This, in turn, can only be achieved if the hardening bath (cooling bath, usually water) is arranged as closely as possible directly behind the extruder for applying the insulating mass. The conventional twin marking devices described above have such a long structural length in the direction of movement of the wire that the requirements of these modern insulating materials for quickly reaching the hardening bath cannot be met.

Since there continues to be a great interest in changing the marking without interrupting the manufacturing process, the return to single drum machines which is necessary up to now in these devices represents a substantial limitation and impairment of the production and it would be very advantageous to overcome these limitations and impairments.

The invention starts at this point and, for avoiding the large dimensions of previously known twin devices in the direction of wire movement, proposes to provide two color disks essentially in a normal plane relative to the direction of the wire movement in the area of the color disks, wherein each of these two color disks can alternately be placed into an active position in which the wire traveling through the device is marked, while the other color disk is in a position in which it is spaced apart from the wire and is in an inactive, passive position or in a position of rest, and vice versa.

The axes of rotation of the two color disks may extend parallel to each other and may define a plane which extends essentially normal relative to the wire travel direction in this area. In that case, the two color disks are advantageously moved between their active and passive positions, wherein the direction of displacement of the disks preferably extends normal relative to the wire travel direction in this area, because this makes it possible to keep the length of the device in the direction of wire movement as small as possible.

It is also possible to arrange the two color disk axes inclined relative to each and to carry out the change between the active position and the position of rest by a pivoting movement; however, this is not preferred because of the complicated movement which makes necessary complicated and, thus, expensive guides and joints.

In the following, the invention will explained in more detail with the aid of a preferred embodiment.

Figure 1:
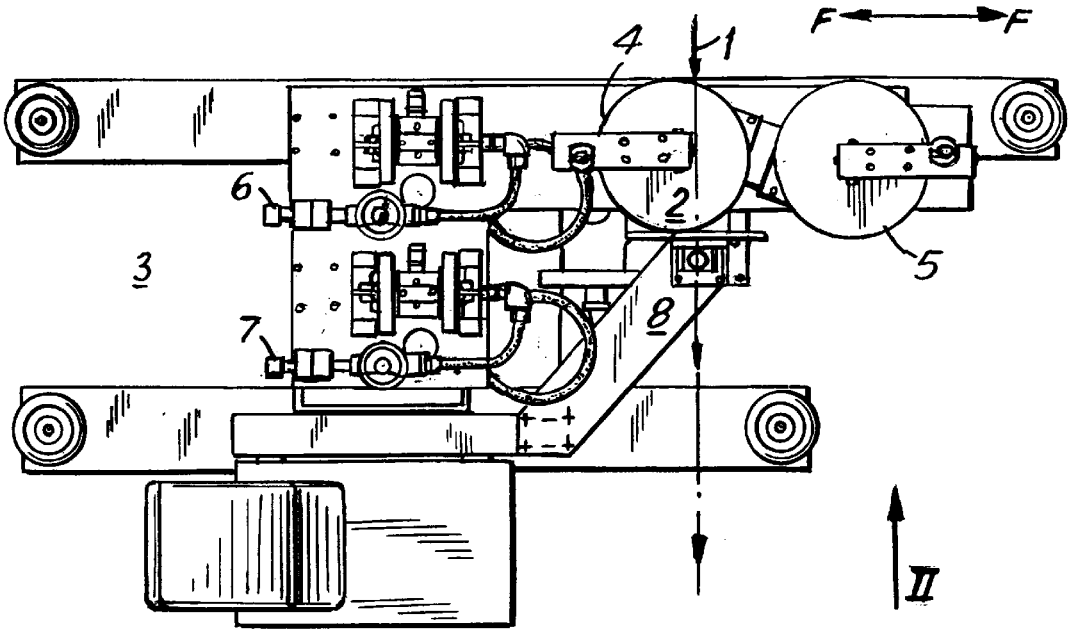
FIG. 1 is a top view of the device according to the invention.

A wire 1 to which an insulation, preferably a foaming insulation, has just been applied, arrives from an extruder by means of which the insulation is applied and the wire 1 moves in the direction of the arrows shown in the drawing. The opening of the extruder can be arranged immediately in front of the entry of the wire into the device according to the invention.

During the further travel of the wire 1 in the direction of the arrows, the wire 1, when reaching the area of the device according to the invention, arrives directly at the color disk 2 without having to traverse a "dead distance" between the border of the device and the color disk.

As explained above, the color disk 2 has a deep circumferential groove into which the wire 1, seen in radial direction, engages deeply without contacting the bottom or the sides of this circumferential groove during the normal operation of the device. In the areas of the two shoulders of the circumferential groove, the color disk 2 has small openings or nozzles. Connecting channels extend from the openings or nozzles in predetermined directions toward the hollow center of the color drum 2 and, due to the centrifugal acceleration, the coloring agent is forced outwardly through the connecting channels and, finally, is sprayed through the fine nozzles onto the wire 1 traveling through the device.

As a result of the distribution of the nozzles in the shoulder area of the circumferential groove and through an appropriate synchronization between the rate of rotation of the color disk 2 and the linear speed of the wire 1, the desired color rings are formed on the wire traveling through the device or on the insulating sheathing. All features described thus far are state of the art and known to the expert in this field, so that a more detailed explanation of these details is not necessary.

It is essential in accordance with the invention that the color disk 2 is not arranged stationary on the device 3; rather, together with its drive motor and its coloring agent supply device, the color disk 2 can be displaced in the direction of double arrow F—F. As a result of this displacement, the color disk 2 is moved into a position in which the wire 1 travels past outside its circumference 4. On the other hand, this displacement causes another color disk 5, constructed in principle in the same manner as color disk 2, but rotating in the opposite direction, to be moved with its circumferential groove into the area of the wire 1 until it assumes a position which is essentially mirror-inverted relative to the position of the color disk shown in FIG. 1. The drive and the coloring agent supply device of the color disk 5 are moved together with the color disk 5.

Since the color disk 2 is connected to a coloring agent supply device 6 and the color disk 5 is connected to a coloring agent supply device 7, it is possible to achieve with the color disk 5 a marking on the continuously traveling wire 1 which is different from that of the color disk 2. This change in the marking is effected by a device control, not shown, which also causes the wire to be cut subsequently at the correct location and ensures that each of the wires is further processed in the intended manner.

As is apparent from FIG. 1, the length of the device in travel direction of the wire 1 is very small. Immediately after the wire has emerged from the respective color disk 2 or 5 assuming the active position thereof and has left the corresponding color mist suction device 8, the wire has already left the area of the marking device. The hardening bath can be arranged immediately following the suction device 8.

This means that, no matter which color disk 2 or 5 assumes the active position or the position of rest, the "working length" of the device is reduced drastically as compared to those of the state of the art and can be reduced substantially below 500 mm and to approximately 250 mm when the suction device 8 is arranged separately. It is only this short structural length which makes possible the problem-free automatic control of capacity and diameter of the wire by means of automatically movable, so-called telescopic cooling grooves, which can now be arranged very closely at the extruder outlet.

Figure 2:
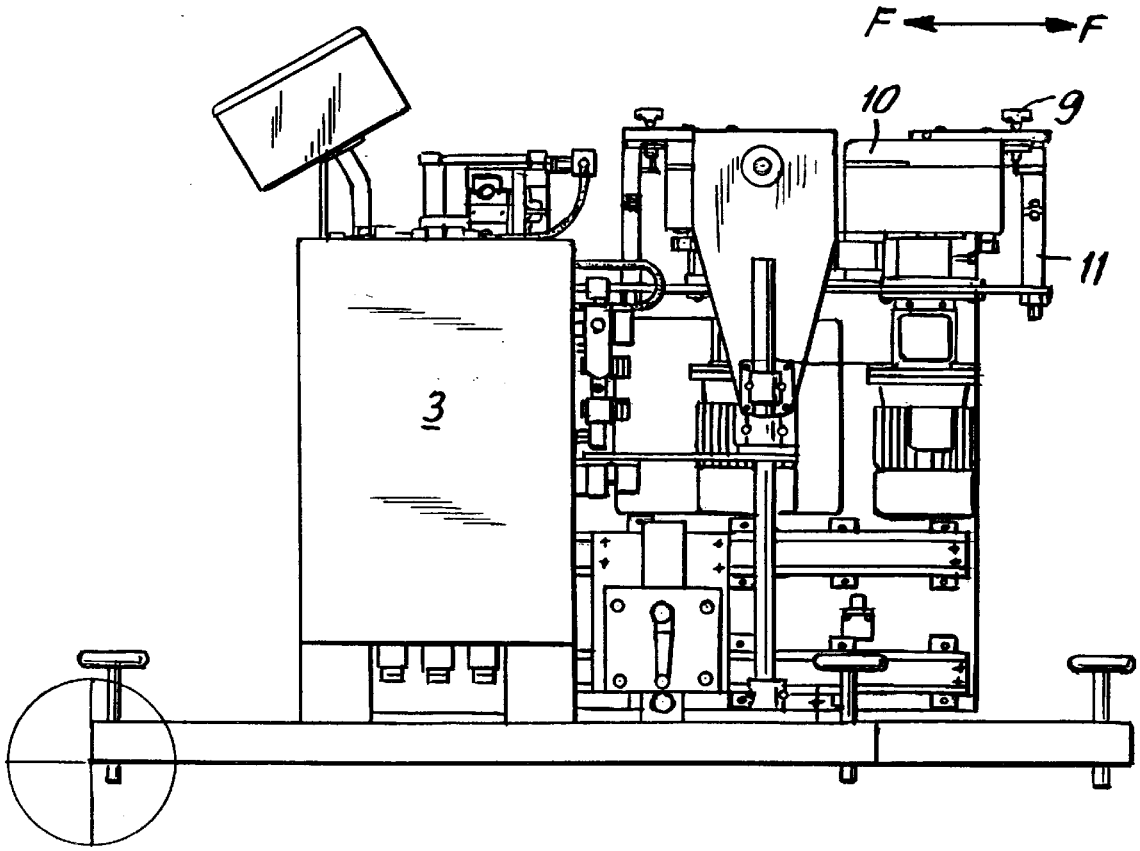
FIG. 2 is a view in the direction of arrow II in FIG. 1.

Moreover, it is apparent, especially from FIG. 1, that the color disk which is in its position of rest has a sufficient distance from the wire 1 in order to be removed from the device and maintained or exchanged against another color disk. The appropriate support or opening device is essentially known in the art and is schematically shown in FIG. 2. In order to gain access to the respective color disk, it is only necessary to loosen a hand screw 9 and to remove a cover 10 by rotating it about an axis 11 to reach the color disk 5.

The color disk 2 as it is used in the device of the present invention will now be explained in more detail with the aid of FIG. 3.

Figure 3:
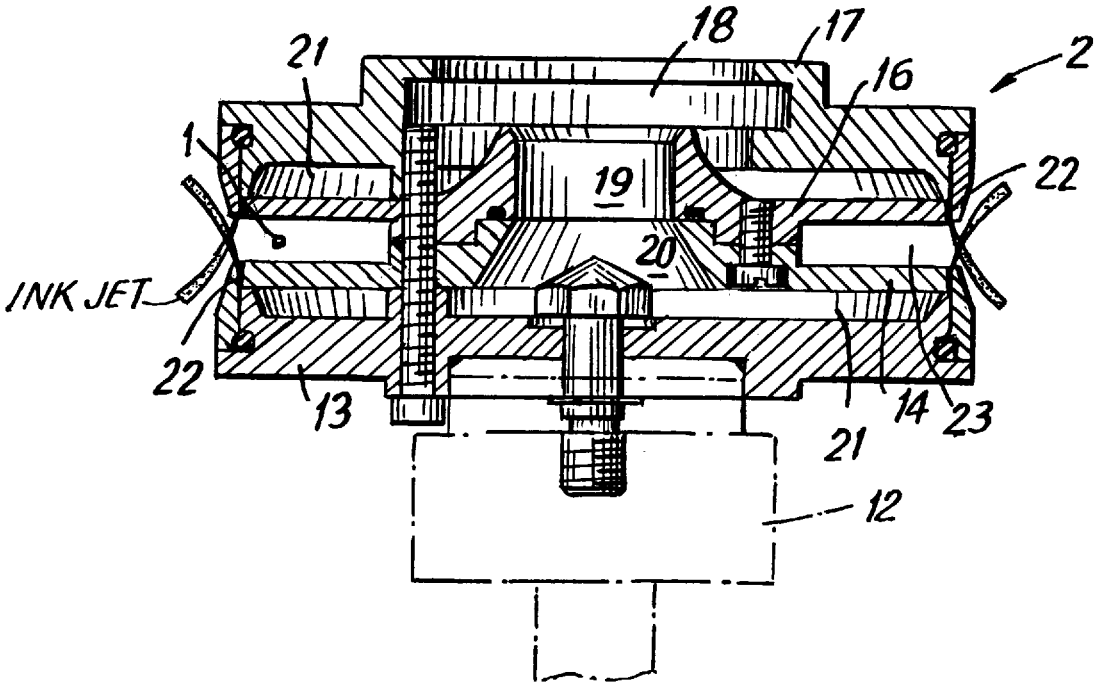
FIG. 3 is sectional view, on a larger scale, showing the color disk as used in the device according to the present invention.

As shown in FIG. 3, the color disk 2 is composed of a bottom disk 13 mounted on a drive 12, a lower inner disk 14 mounted on the bottom disk 13 and an upper inner disk 16 mounted on the lower inner disk 14. An upper cover disk 17 is mounted, in turn, on the upper inner disk 16 in the same manner as the bottom disk 13 is mounted on the lower inner disk 14.

The upper cover disk 17 has in its area near the axis an ink supply opening 18 and the two inner disks 14 and 16 are also provided with openings 19 and 20 in this area. The ink supply openings 18, 19, 20 are in communication with ink ducts 21 which conduct the ink radially outwardly as a result of the rotation of the color disk.

At the outer end of each duct 21 is provided an ink nozzle 22 through which the ink is ejected outwardly as shown in FIG. 3.

In FIG. 3, the ink nozzles 22 are illustrated offset by 180° and the upper and lower ink nozzles are shown at the same angular positions. As is clear from the description below, it is possible instead to provide more or less than 2 ink nozzles 22 on the upper side and the lower side and the upper ink nozzles are usually offset relative to the lower ink nozzles in such a way that one set of nozzles spray ink at the wire as it enters the groove 23 and the other nozzles spray ink against the wire when it leaves the groove 23 in order to form the other half of the annular marking on the wire.

The invention is not limited to the illustrated embodiment. For example, it is possible to construct a device in which, for example, the color disk 5 is moved in horizontal position, while the color disk 2 is moved in vertical or inclined direction. It is also possible to arrange the axes of rotation of the two color disks not in vertical direction as in the illustrated embodiment, but in horizontal direction (the entire device would then have to be imagined turned by 90°) and to provide the displacement movement of the two color disks in vertical direction. This arrangement would result in a reduction of the required floor space (although the dimension in the most important direction, i.e., the direction of movement of the wire 1, would not be reduced); however, this arrangement would have the disadvantage that any excess coloring agent would drip also from the upper color disk which is in the position of rest onto the lower color disk or onto the wire 1 and would lead to contamination and possibly erroneous markings.

Finally, it is readily apparent to the expert that the two color disks do not have to be located in a common plane, i.e., the axes of rotation of the color disks do not have to be arranged parallel to each other, and that the exchange between the position of rest and the work position can also be achieved by swinging the appropriate part of the device 3 instead of displacing that part. As mentioned above, this is not preferred because of the more complicated guides and more complicated sequences of movement, however, this solution may be appropriate in certain fields of application.

Moreover, it is possible to effect the change between the active position and the inactive position separately for each of the two color disks 2, 5; this provides the advantage that both color disks can be in the inactive position thereof simultaneously which may facilitate maintenance (when the machine is idle). If the color disks are arranged so as to be movable together on an appropriately movable carrier, this provides the significant advantage of a simple construction of the device and the reliably synchronous exchange of the two color disks.

The control and regulation of the device according to the invention does not pose a problem to the expert in the field of twin marking devices when being familiar with the invention; Rather, the control and regulation can easily be derived from the known controls.

Thus, the invention makes it possible in all its variations and embodiments, by the arrangement of the axes of rotation of the color disks in a plane extending essentially normal relative to the wire travel direction, that the exchange from one marking to another can be carried out in a particularly narrow spatial range as seen in the direction of movement of the wire.

I claim:

1. A twin marking device comprising two color disks which rotate about axes of rotation and alternatingly release coloring agent for applying markings onto the insulating sheathing of a wire, wherein the wire is moved in a wire travel direction essentially along a straight line past the color disks, wherein a) the axes of rotation of the two color disks extend essentially in a plane normal relative to the wire travel direction in the area of the color disk;

b) means for alternatingly moving one of the two color disks in a moving direction between an active position in which the color disk marks the wire and an inactive position in which the color disk is spaced from the wire and for moving another of the two color disks in the moving direction between an inactive position in which the color disk is spaced from the wire and an active position in which the color disk marks the wire; and c) wherein the moving direction of each of the color disks between the active position and the inactive position extends essentially normal relative to the wire travel direction.

2. The twin marking device according to claim 1, comprising means for synchronizing the movements of the two color disks relative to a wire speed between the active position and the inactive position.

3. The twin marking device according to claim 2, further comprising a common carrier for the two color disks which is mounted so as to be movable back and forth essentially normal relative to the wire travel direction.

* * * * *

UNITED STATES PATENT AND TRADEMARK OFFICE

CERTIFICATE OF CORRECTION

PATENT NO. : 5,813,325
DATED : September 29, 1998
INVENTOR(S) : Kurt Descovich

It is certified that error appears in the above-identified patent and that said Letters Patent is hereby corrected as shown below:

On the title page, item:

[73] Assignee: Medek & Schörner Gesellschaft m.b.H., Vienna, Austria

Signed and Sealed this

Twenty-third Day of March, 1999

*Attest:*

Q. TODD DICKINSON

*Attesting Officer*

*Acting Commissioner of Patents and Trademarks*